US010168048B2

(12) United States Patent
Downing

(10) Patent No.: US 10,168,048 B2
(45) Date of Patent: Jan. 1, 2019

(54) DUAL FUEL BURNER PRESSURE SWITCH SHUT OFF MECHANISM

(71) Applicant: GHP Group, Inc., Niles, IL (US)

(72) Inventor: Verlon (Dan) Downing, Niles, IL (US)

(73) Assignee: GHP Group, Inc., Niles, IL (US)

( * ) Notice: Subject to any disclaimer, the term of this patent is extended or adjusted under 35 U.S.C. 154(b) by 523 days.

(21) Appl. No.: 14/923,858

(22) Filed: Oct. 27, 2015

(65) Prior Publication Data

US 2016/0116163 A1 Apr. 28, 2016

Related U.S. Application Data

(60) Provisional application No. 62/069,060, filed on Oct. 27, 2014.

(51) Int. Cl.
*F23N 1/00* (2006.01)

(52) U.S. Cl.
CPC ..... *F23N 1/002* (2013.01); *F23N 1/007* (2013.01); *F23N 2037/08* (2013.01)

(58) Field of Classification Search
CPC ..... F23N 1/002; F23N 1/007; F23N 2037/08; F23N 1/027; F23N 5/242; F23N 2021/10; F23N 2035/06; F23D 14/10; F23D 14/60; F23D 14/64; F24C 3/006
See application file for complete search history.

(56) References Cited

U.S. PATENT DOCUMENTS

2014/0248571 A1 9/2014 Deng

OTHER PUBLICATIONS

Canada Office Action for Application No. 2,910,345 dated Jul. 17, 2017, 3 pages.

*Primary Examiner* — Alfred Basichas
(74) *Attorney, Agent, or Firm* — Seyfarth Shaw LLP

(57) ABSTRACT

A mechanism for maintaining and controlling optimal burning conditions in a dual fuel burner involving electrical circuitry which includes pressure detection of a fuel source pressure to determine if an incorrect fuel source has been utilized.

12 Claims, 3 Drawing Sheets

DUAL FUEL BURNER PRESSURE SWITCH SHUT OFF MECHANISM

CROSS REFERENCE TO RELATED APPLICATIONS

The present application claims priority from U.S. Application Ser. No. 62/069,060, filed Oct. 27, 2014, which is incorporated by reference herein in its entirety.

FIELD OF THE INVENTION

The invention relates generally to gas burning units, such as vent free log sets, fireplaces, wall heaters and similar devices and, in particular, to an apparatus and method by which a dual- or multi-fuel burning unit, in conjunction with the main controller valve, may monitor and control the flow of fuel.

BACKGROUND OF THE INVENTION

Currently, heating units, such as fireplaces, are desirable features in the home. Devices that burn non-solid materials, such as gas, or that produce heat electrically have gradually gained popularity. Like wood, the combustion of gas can provide "real" flames, and heat, but oftentimes entails a careful mixing of gas and air for desired or optimal performance, and a realistic flame. This aspect of the gas fireplace, and similar appliances, typically involves the delivery of air for combustion to an arrangement or device where the air is mixed with gaseous fuel, e.g., natural gas (NG) and liquid propane (LP) ("gas"). Clearly, it is advantageous that the air and gas are mixed at a ratio for proper combustion. Then, the mixed air and gas are delivered to a burner element or member, and ultimately provided to a combustion chamber of the fireplace. The mixing of air and gas is oftentimes accomplished in the burner itself.

There has also been a desire by some, such as stores and dealers that sell fireplaces and the like, to have a unit that can operate on different kinds of fuel. In many homes and other buildings, there may be NG or LP available. Sellers may therefore ask for a unit that can be adapted for either NG or LP, depending on what source of gas is available, or desired for the installation. Accordingly, units that may be configured to operate with more than one fuel source were developed. These are typically referred to as "dual-source" or "dual fuel" units. For example, the burner element may include a system that, when in one selected position, allows the unit to operate with a first fuel, and when in a second position, allows the heating unit to operate with a second fuel. These dual-source units are typically set up so that a choice of fuel is made by the installer when the unit is first put into operation. While such dual-source units have been in the art for decades, there is always a desire to make the units simpler to install, safer and more efficient.

Further, different fuels require different conditions to obtain an optimal burn. Such conditions include the amount of oxygen in the burning chamber and the rate of the gas flowing into the burner. Failure to match fuel type to proper burning conditions may result in suboptimal burns and decreased safety. Specifically, an LP gas source allowed to flow through a system metered for NG gas will create a significantly higher burn rate and increased system temperatures than the intended design parameters.

SUMMARY OF THE INVENTION

In accordance with an aspect in one embodiment, a dual fuel burner incorporates a gas-type selector selectively able to be engaged with a selector switch which is connected to one branch of a parallel electrical circuit. The selector in one form contains a radially extending tine capable of engaging an actuator button on a microswitch when rotated to a selection position. For example, the tine may depress the actuator button opening the switch and disabling one branch of the circuit when positioned in the NG position. When the button is not depressed, the selector is in an LP condition and the circuit is closed or engaged.

A pressure switch is upstream from a convertible pressure regulator. The pressure switch senses the pressure of incoming LP or NG gas. When the Selector device is aligned to the LP gas position, the tine is disengaged from the selector switch, leaving the first branch of a parallel circuit in the Normally Closed (NC), or on, position.

However, when the Selector device is aligned to the NG gas position the tine depresses the selector switch and opens or disables one branch of a parallel circuit. If the pressure switch detects a higher than 10 in$H_2O$ pressure (the pressure associated with an LP gas flow), the pressure switch opens or disables the second branch of the circuit. Because both branches of the parallel circuit are open, the circuit disconnects the thermocouple current and shuts off gas flow through the main control valve, thereby shutting down the burner assembly. Shutting down the assembly prevents unsafe or suboptimal burn conditions where LP gas with a higher heating value than NG flows into an assembly set for NG and leads to a flame that is too hot. Likewise, an NG flow with an LP gas setting is undesirable.

Other circuits employing a pressure switch can be envisioned. In essence, the state of the circuit is set by the gas selection device (selector), which mechanically engages a switch. The Selector could also convey a signal to a switch which then sets the state of the circuit, rather than a mechanical operation.

The aspects, advantages, features and details of the invention will be further understood in consideration of the following detailed description of certain embodiments taken in conjunction with the drawings, in which:

DETAILED DESCRIPTION OF AN EMBODIMENT OF THE INVENTION

In the following detailed description, reference is made to the accompanying Figures, which form a part thereof. In the Figures, the same numbers typically identify similar components, unless context dictates otherwise. The illustrative embodiment described in the detailed description and Figures. Modifications along with noted variations and alternatives are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are contemplated herein. For instance, while the invention is described hereafter in the context of a fireplace burner, it will be understood that the technology can be readily applied to applications in wall heaters, gas log sets, and other types of "fires." Similarly, the invention may have application to a burner utilizing more than two fuels, each of which has a different source pressure.

Figure 1:
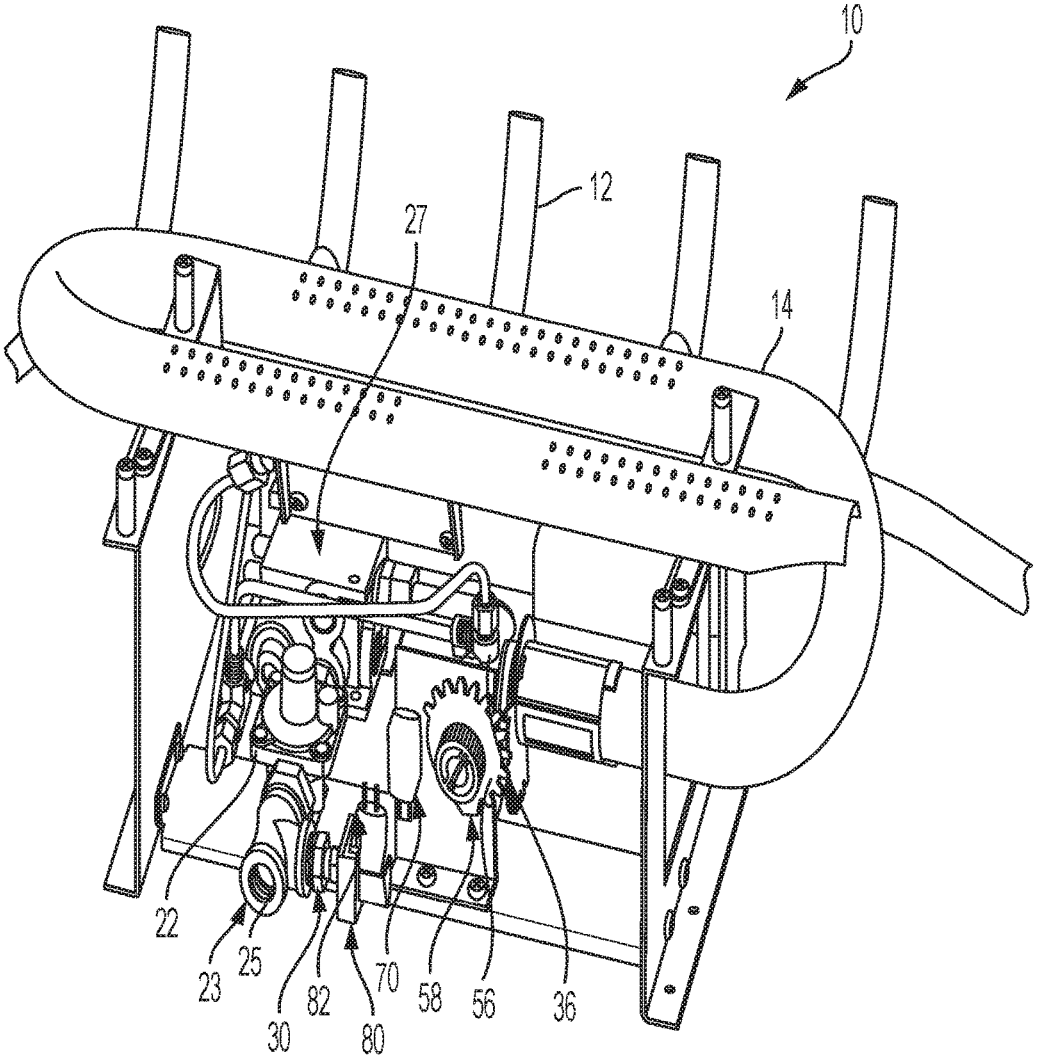
FIG. 1 shows a perspective view of a burner unit in a fireplace assembly as might be used with the present invention.

FIG. 1 shows an exemplary gas-fueled burner unit 10, which in one embodiment shown here, is provided in a fireplace-ready assembly including a faux fireplace grate 12. As noted, the invention is not limited to this type of burner or in a fireplace environment, but could be applicable to gas heaters and other gas fires. Gas burner unit 10 includes a burner element in the form of a burner tube 14. There is a pilot flame assembly which in this embodiment includes a pair of pilot light and oxygen depletion sensor (ODS) assemblies, which are not shown. Two ODS assemblies are used, one for each type of fuel that could be employed with this dual-fuel unit.

The depicted burner element is in the form of a tube, curved upon itself at the elongated ends of the unit. The burner element 14 need not be tubular, and could be a plate-type burner, or other conventional burner element. As will be understood, much of the burner unit 10 is conventional, with parts and operation well known to those of skill in the art. Or, for example, a burner unit incorporating the present invention may be that depicted in U.S. patent application Ser. No. 14/209,250, filed Mar. 13, 2014, the contents of which are by this reference hereby incorporated into this specification. What will be understood is that gas flow will be directed upon selection of the flow path or paths for that particular type of gas. How that gas flow is actually accomplished in terms of structure can vary, as the present invention is concerned with assuring that the proper flow path(s) has been selected for the intended gas, using gas pressure sensed at the source input to the unit (e.g., prior to any pressure regulator device). Accordingly, the discussion herein will be relatively limited to the pressure sensing features, circuitry and how that effects the operation of the burner 10.

The burner 10 has a fuel delivery arrangement which permits the use of either natural gas (NG) or liquid propane (LP). This gives the installer, or homeowner, the option of choosing a fuel, assuming that the fuel option is available. It likewise provides the manufacturer and distributer with a system that can be used for either fuel, thereby providing the ability to reduce inventory (of units otherwise dedicated to one fuel or the other).

Either NG or LP gas is fed from a source to a connector 23 having an inlet opening 25 which is threaded in conventional fashion for connection with a source hose coupling, thence to a typical regulator unit 22. This regulator unit 22 may be similar or the same as those supplied by Maxitrol. It is an adjustable regulator that is adaptable for either LP or NG, which are supplied at different pressures. From the regulator 22, the gas progresses through a tube to a standard-type main valve controller 27. For example, a SIT630 Eurosit controller may be used. The controller 27 has a gas level control knob for adjusting the flame, as well as "off" and "pilot" positions. A typical igniter (not pictured) for the burner would also be provided.

These dual source burners incorporate first and second pilot/ODS assemblies. ODS assemblies are well known in the art and are in fact mandated for all indoor units. These are two independent assemblies, each of which is used with a respective gas. Each assembly has a thermocouple and an electrode or igniter. Gas from a respective pilot gas line is supplied through a nozzle with each assembly. It will be noted that in the aforementioned U.S. patent application Ser. No. 14/209,250 disclosure, a system is employed which provides a flow of LP gas to only one pilot, while NG gas is provided to both pilots. That is but one way for gas flows within a system. Gas from a pilot nozzle is ignited and then provides a flame to one (for LP) or both of the two thermocouples (for NG), depending upon which of NG or LP gas has been selected.

The selection of flow paths for NG or LP is made via the selector valve 36. Selector valves such as those made by Copreci, model no. CPM 21400 or as shown in U.S. Pat. No. 7,766,006, may be used. Briefly, the valve 36 has an internal manifold which serves to route fuel through the valve to a certain outlet or outlets. The route of the fuel is determined by the manual rotation of an axel (not pictured), such as by the installer's manipulation, through use of a selector knob 56, which is fixed to the outboard end of the axel. Rotation of the knob 56 may place the valve in a first (LP) configuration or a second (NG) configuration. Doing so will rotate the axel and allow fuel to flow to the respective pilot/ODS assemblies depending upon which configuration is selected. A more thorough explanation may be found in U.S. patent application Ser. No. 14/209,250.

Figure 2:
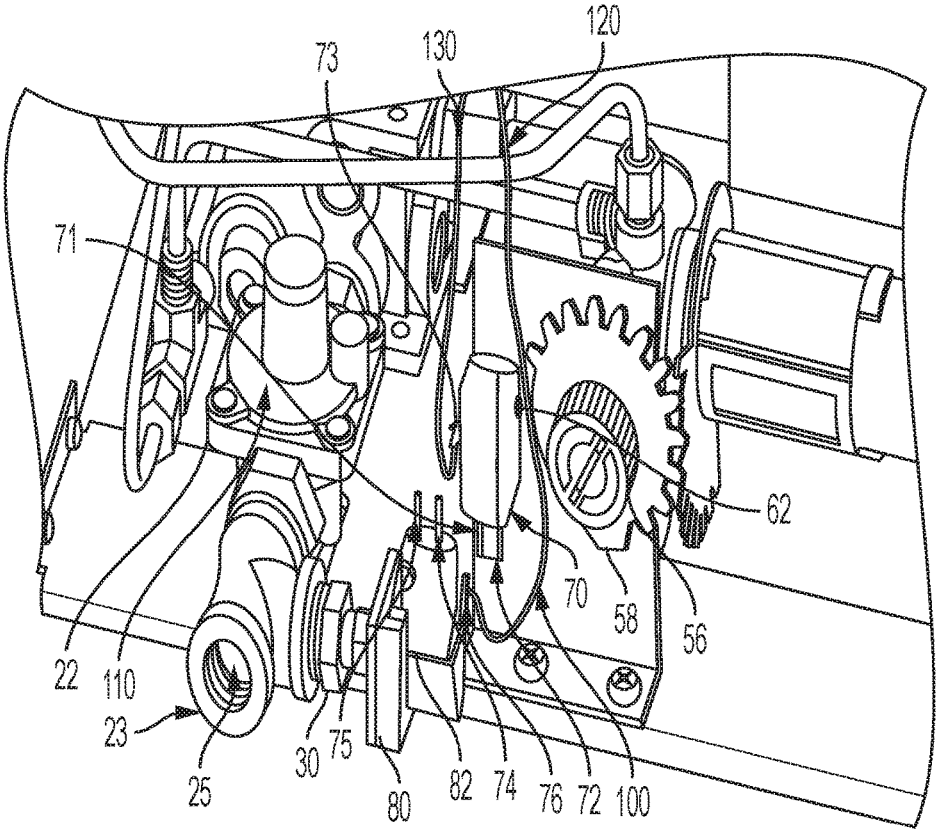
FIG. 2 shows an partial view of the burner unit depicted in FIG. 1.

As shown in FIGS. 1 and 2, the burner assembly 10 includes an electrical circuit that incorporates a double pole microswitch 70 selectively engageable with the knob 56, a pressure sensor 80, which measures the line pressure of the incoming gas flow from the source, and a pressure switch 82 upstream from the regulator 22.

The pressure sensor used in this embodiment is made by GHP Group, Inc. The connector 23 is provided with at T, with a second opening or port to which a pressure switch mount 30 is attached. The pressure sensor 80 is affixed to the mount 30, and is in communication with a channel in the mount which is open to the source gas coming into the assembly 10. The pressure switch 82 is mechanically coupled to the pressure sensor 80. The pressure switch 82 can thus be switched "off" or "on" by the pressure sensor 80 depending upon the pressure of the incoming gas detected. Other arrangements can be readily considered while remaining within the scope of the invention so long as the pressure sensor 80 and switch 82 are affixed to the connector to detect the pressure of the incoming gas.

As discussed, the knob 56 may be manually rotated between a first (LP) position and a second (NG) position. In this embodiment, the knob contains a radially outwardly extending tine 58 or finger. The knob 56 in FIG. 1 is in the LP position. When the knob 56 is rotated to the NG position, which in this version is clockwise from the LP position, the knob 56 rotates into a position such that the tine 58 engages and depresses an actuator 62, or nub, on the microswitch 70.

Standard double pole switches, such as those produced by Honeywell or Jinhe, may be used for the microswitch 70 or pressure switch 80. Other types of switches can be readily contemplated for accomplishing the function of registering whether the knob 56 has been rotated to a particular position (or whatever other device used for selection has had a change of state or position). As is standard in double pole switches, microswitch 70 contains electrical contacts 71, 72, 73, while pressure switch 80 contains electrical contacts 74, 75, 76. Contacts 71 and 74 are Normally Open (NO) while contacts 72 and 75 are Normally Closed (NC). Contacts 73 and 76 are the Common (COM).

A lead 100, or wire, connects contacts 71, 72 on microswitch 70 to contacts 74, 75 on pressure switch 82. A lead 110 also connects contacts 74, 75 to the main valve controller 27. As discussed previously, the controller 27 has a gas level control knob for adjusting the flame, as well as "off" and "pilot" positions. The common contacts 73, 76 on the microswitch 70 and pressure switch 82 are connected via leads 120 and 130 to the first and second pilot/ODS assemblies (not pictured). As such, the circuit formed connects the controller 27 to the ODS assemblies via the microswitch 70 and pressure switch 82.

Figure 3:
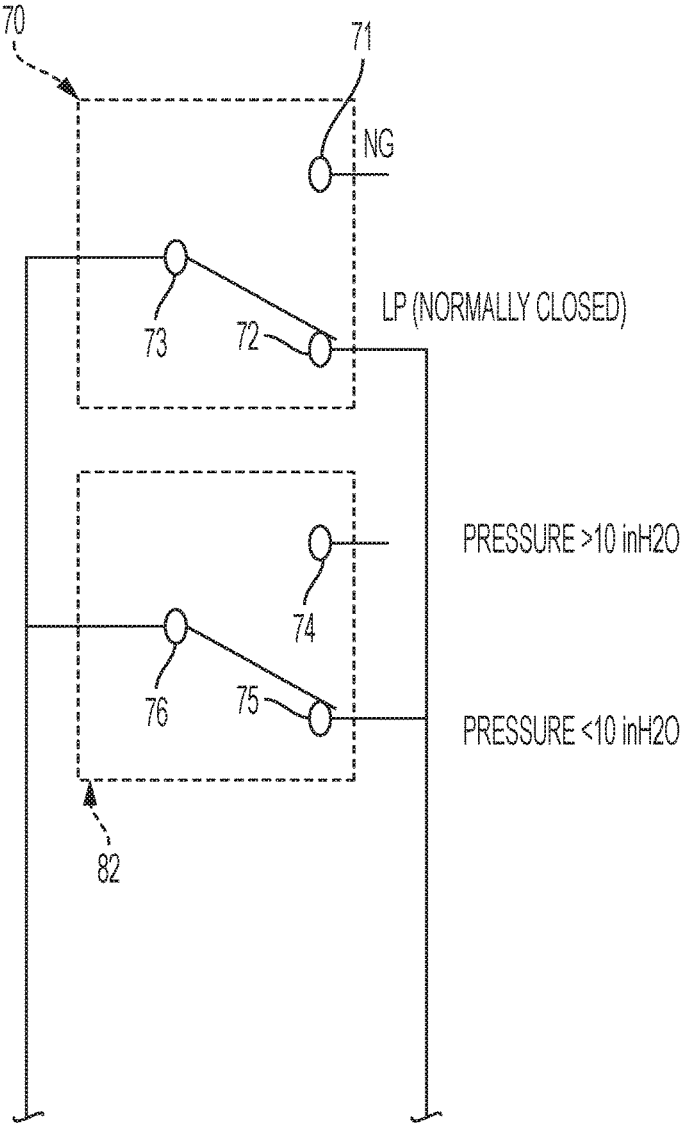
FIG. 3 shows a circuit diagram depicting one version of an electrical circuit using a pressure sensor and selector state switch contained in a structure made in accordance with the invention.

As shown in the circuitry diagram in FIG. 3, an exemplary circuit 100 uses electrical signals from the pressure switch 82 and the microswitch 70 to operate the main valve controller 27, so as to permit gas to the burner or shut it off. Main valve has a typical solenoid element which serves to open and shut the gas flow. As depicted in FIG. 3, in this version the system is initially set for LP gas, with microswitch 70 in a Normally Closed (NC) condition when the selector knob 56 is in the LP position, i.e., when the actuator 62 has not been depressed.

When the selector knob 56 is rotated to NG mode, the tine 58 engages the actuator 62. Depressing the actuator 62 flips the microswitch 70 to the Normally Open (NO) position, which opens the circuit and causes one branch of the circuit to the thermocouple to be inoperable.

The pressure switch 82 is set to a position where it is normally closed when a pressure is detected lower than that of LP, which would be that of NG in this embodiment. A standard operating pressure for LP gas, commonly measured in inches of water, is about 10 to 11 inches of water, or 10 inH2O. Thus, if the pressure measured is less than 10 inH2O, the pressure switch 82 will remain in the normally closed position. If a pressure greater than about 10 inH2O is detected, however, then the pressure switch 82 opens and the other branch of the circuit to the thermocouple is inoperable.

Thus, if the system has been set for NG, as determined by the microswitch 70, but an LP source has been in fact connected, the higher LP pressure detected by the pressure sensor 80 will flip the pressure switch 82, causing a signal to be generated that will trip the main valve controller and shut off gas flow. This prevents the high heating value of the LP gas to burn at a rate that is too high for the set burning environment. When the converse situation arises, where the system has been set for LP but a lower pressure NG source has been connected, the NG will continue to flow into the ODS pilot. However, because the NG gas flow and heating value is too low to hold the LP thermocouple open, the ODS pilot will shut off.

While the invention has been described with respect to certain embodiments, variations and modifications will be recognized by those of skill in the art which will nonetheless come within the spirit and scope of the invention, as further set forth in the claims which follow.

What is claimed is:

1. In a dual fuel fire burner assembly to which at least two kinds of gaseous fuel can be supplied, the dual fuel fire burner assembly adapted to receive at least two sources of fuel, each source of fuel providing a distinctive fuel having a source pressure that differs from the source pressure of the other source of fuel, with a fuel selector operable to place the burner assembly in condition for use of a selected fuel, the two sources of fuel being controlled through a main controller valve, the burner assembly comprising:

a pressure detector which detects pressure of the fuel source and provides a fuel pressure indication of the fuel pressure, the pressure detector coupled to an electrical pressure switch;

a tine associated with the fuel selector which provides a tine indication of the fuel selected, the tine coupled to an electrical selector switch;

a parallel electrical circuit comprising the pressure switch and the selector switch, the pressure switch adapted to open or close a first branch of the parallel circuit based upon the fuel pressure indication and the selector switch adapted to open or close a second branch of the parallel electrical circuit based upon the tine indication, wherein the two switches close the main controller valve to shut off fuel supply if the fuel pressure indication does not match the tine indication.

2. The burner assembly of claim 1, wherein the pressure switch disables the electrical circuit when the pressure indication does not match a particular tine indication.

3. The burner assembly of claim 1, wherein the pressure switch opens the first branch of the electrical circuit when the pressure detected by the pressure detector is greater than a pressure threshold of the fuel selected by the tine.

4. The burner assembly of claim 3, wherein the pressure threshold is greater than or equal to about 10 inH2O.

5. A method for monitoring and controlling at least two sources of fuel supplied in a dual- or multi-fuel burner assembly, each source of fuel providing a distinctive fuel having a fuel pressure that differs from the fuel pressure of the other source of fuel, comprising the steps of:

selecting the source of fuel with a fuel selector operable to place the burner assembly in condition for use of a selected fuel, the fuel selector coupled to an electrical selector switch on a first branch of a parallel electrical circuit;

detecting the fuel pressure of the source of fuel via a pressure sensor coupled to an electrical pressure switch on a second branch of the parallel electrical circuit, the pressure sensor providing a pressure indication;

electrically disabling a main controller valve when the pressure indication does not match the fuel pressure of the selected fuel by opening the pressure switch.

6. The method of claim 5, wherein the electrical circuit is disabled when the pressure detected by the pressure sensor is greater than a pressure threshold of the selected fuel.

7. A safety assembly for a burner unit which is capable of operating on at least two different gas fuels, each gas fuel having a different source pressure, comprising:

a selector which is manually operated by a user to select between the gas fuels as an input to the burner unit from a main fuel line;

a pressure detector communicating with a fuel source input, the pressure detector sensing a pressure level of the fuel being inputted and providing pressure indication of the pressure level;

a valve operating to open or close a main fuel line to the burner unit;

an electrical circuit including the pressure detector indication, the valve, a pressure switch coupled to the pressure detector, and a selector switch, the selector switch being operated by the selector to place the circuit into a selected state, wherein the pressure switch serves to disable the circuit and operate the valve to close the main fuel line if the selected state does not match the pressure level.

8. The safety assembly of claim 7, wherein the selector is movable between fuel selection positions and has a tine which mechanically engages the selector switch, the selector switch having an element engaged by the tine to place the pressure switch into a selected state corresponding to a selected fuel.

9. The safety assembly of claim 8, wherein the valve is a solenoid valve.

10. The safety assembly of claim 9, wherein the burner unit has a main fuel line which is connected to a fuel source at a main fuel input, and a pressure regulator upstream from the main fuel input, the pressure sensor being in communication with the main fuel line downstream from the pressure regulator so as to sense the pressure from the fuel source.

11. The safety assembly of claim 10, wherein the selector is a rotary device manipulated by a user to rotate between two positions indicative of a selected fuel, the rotary device having the tine which engages and depresses the element on the pressure switch for one of the selected fuels.

12. The burner assembly of claim 1, wherein the tine mechanically opens the second branch of the electrical circuit via the selector switch when the fuel having a lower source pressure is indicated by the tine.

* * * * *